US006259339B1

(12) United States Patent
Simms et al.

(10) Patent No.: US 6,259,339 B1
(45) Date of Patent: Jul. 10, 2001

(54) REMOTELY CONTROLLABLE CIRCUIT BREAKER WITH COMBINED VISUAL INDICATION OF STATE AND MANUAL OVERRIDE

(75) Inventors: Kevin Anthony Simms, Library; Jeffrey Wayne Lockhart, Bellevue; Michael Joseph Erb, Fombell, all of PA (US)

(73) Assignee: Eaton Coporation, Cleveland, OH (US)

( * ) Notice: Subject to any disclaimer, the term of this patent is extended or adjusted under 35 U.S.C. 154(b) by 0 days.

(21) Appl. No.: 09/514,103

(22) Filed: Feb. 28, 2000

(51) Int. Cl.[7] ..... H01H 75/00
(52) U.S. Cl. ..... 335/14; 335/20
(58) Field of Search ..... 335/14, 20, 25–27, 335/167–172, 202

(56) References Cited

U.S. PATENT DOCUMENTS

Re. 32,882 * 3/1989 Yokoyama et al. ..... 335/14
4,164,719 * 8/1979 Young et al. ..... 335/14
5,164,693 * 11/1992 Yokoyama et al. ..... 335/20
5,301,083 4/1994 Grass et al. .
5,373,411 12/1994 Grass et al. .
5,633,776 5/1997 Juncu et al. .

FOREIGN PATENT DOCUMENTS 195 08 494A1 * 3/1995 (DE) .

* cited by examiner

*Primary Examiner*—Lincoln Donovan
(74) *Attorney, Agent, or Firm*—Martin J. Moran

(57) ABSTRACT

A remotely controllable circuit breaker has a set of secondary contacts in series with the main contacts and which can be opened and closed from a remote location by a magnetically latchable solenoid. A pivotally mounted operating member/indicator member coupled to the plunger of the solenoid by a non-magnetic pin has an extension which projects through an opening in the circuit breaker housing to provide an indication of the open/closed state of the set of secondary contacts and an operator for manually closing them.

17 Claims, 3 Drawing Sheets

REMOTELY CONTROLLABLE CIRCUIT BREAKER WITH COMBINED VISUAL INDICATION OF STATE AND MANUAL OVERRIDE

RELATED APPLICATION

Commonly owned, concurrently filed application entitled "Remotely Controllable Circuit Breaker" and identified by appln. Ser. No. 09/514,458.

BACKGROUND OF THE INVENTION

1. Field of the Invention

This invention relates to circuit breakers for protecting electric power circuits. More particularly, it relates to a set of secondary contacts which can be remotely controlled, but can be manually closed at the breaker. It further relates to such a circuit breaker with an indicator which provides an indication of the open/closed state of the set of secondary contacts.

2. Background Information

Circuit breakers used in residential and light commercial applications are commonly referred to as miniature circuit breakers because of their limited size. Such circuit breakers typically have a pair of separable contacts opened and closed by a spring powered operating mechanism. A thermal-magnetic trip device actuates the operating mechanism to open the separable contacts in response to persistent overcurrent conditions and to short circuits. Usually, circuit breakers of this type for multiple circuits within a residence or commercial structure are mounted together within a load center which may be located in a basement or other remote location. In some applications, it has been found convenient to use the circuit breakers for other purposes than just protection, for instance, for load shedding. It is desirable to be able to perform this function remotely, and even automatically, such as with a computer. However, the spring powered operating mechanisms are designed for manual reclosure and are not easily adapted for reclosing remotely. In any event, the mechanisms are not designed for repeated operation over an extended period of time.

U.S. Pat. Nos. 5,301,083 and 5,373,411 describe a remotely operated circuit breaker which introduces a second pair of contacts in series with the main separable contacts. The main contacts still interrupt overcurrents, while the secondary contacts perform the discretionary switching operations. The secondary contacts are controlled by a solenoid which is spring biased to close the contacts. The solenoid has two coils, an open coil and a hold coil. Initially, both coils are energized to open the contacts. Power to the open coil is then turned off, and only the hold coil remains energized. Thus, continuous power is required to keep the main contacts open. When power to the hold coil is terminated, the spring recloses the secondary contacts. Commonly owned, concurrently filed U.S. Patent Application identified by Attorney Docket No. 99-PDC-269 discloses a magnetically latchable solenoid which only requires momentary power to switch between the open and closed states. In both of these remotely operated circuit breakers, the secondary contacts are not controllable at the circuit breaker. They can only be controlled by the remotely generated signals. There are times when it is desirable to place the circuit breaker back in service from the location of the circuit breaker. The main contacts can be reclosed by the handle provided on the circuit breaker, but this does not close the secondary contacts. It is also desirable to be able to determine the status of the secondary contacts of the remotely operated circuit breaker. Again, the handle indicates the position of the main contacts, but indicates nothing with respect to the secondary contacts.

Accordingly, there is a need for an improved remotely operated circuit breaker.

More particularly, there is a need for such a circuit breaker having remotely controllable secondary contacts which can also be controlled at the circuit breaker.

There is also a need for such a remotely operated circuit breaker which provides at the circuit breaker an indication of the open/closed state of the secondary contacts.

SUMMARY OF THE INVENTION

These needs and others are satisfied by the invention, which is directed to a remotely controllable circuit breaker which includes a manual operator coupled to the plunger of a solenoid which opens and closes the secondary contacts of the breaker in response to the remote electrical signals. The operator is manually operable from outside the housing of the circuit breaker to manually move the plunger and thereby close the set of secondary contacts. More particularly, the invention is directed to a remotely controllable circuit breaker which includes a housing, a set of main contacts mounted in the housing, an operating mechanism mounted in the housing and coupled to the set of main contacts for opening and closing the main contacts. The remotely controllable circuit breaker further includes a set of secondary contacts mounted in the housing and connected in series with the set of main contacts. The secondary contacts have an open and a closed state. A solenoid also mounted in the housing has a plunger moveable to a first position to operate the secondary contacts to the closed state. The plunger is also moveable to a second position to operate the secondary contacts to the open state. A manual operator coupled to the plunger is operable from outside the housing to manually move the plunger from the second position to the first position to manually operate the secondary contacts to the closed state.

Preferably, the manual operator is an operating member supported by a pivotal mount and spring biased toward the plunger. Most preferably, this operating member has a first leg biased toward the plunger by the spring and a second leg projecting through an opening in the housing and rotatable within the opening to close the second set of contacts manually. The operating member is coupled to the plunger by a non-magnetic pin projecting from the solenoid and against which the first leg of the operating member is biased by the spring, or in the alternative, is connected. This operating member is also a position indicator which provides a visual indication at the circuit breaker of the status of the secondary contacts. Thus, the invention is also directed to a remotely controllable circuit breaker which includes a position indicator providing an indication of the open and closed states of the set of secondary contacts observable external to the circuit breaker housing.

More particularly, the invention is directed to a remotely controllable circuit breaker which includes a housing, a set of main contacts within the housing, an operating mechanism mounted in the housing and coupled to the set of main contacts for opening and closing the main contacts. The remotely controllable circuit breaker further includes a set of secondary contacts mounted in the housing and connected in series with the set of main contacts. The secondary contacts have an open state and a closed state. A remotely operated actuator housed in the housing selectively moves the second set of contacts between the open and closed states. A position indicator supported by the housing provides an indication observable external to the housing of the open and closed states of the secondary contacts. Preferably, the actuator is a solenoid having a plunger.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
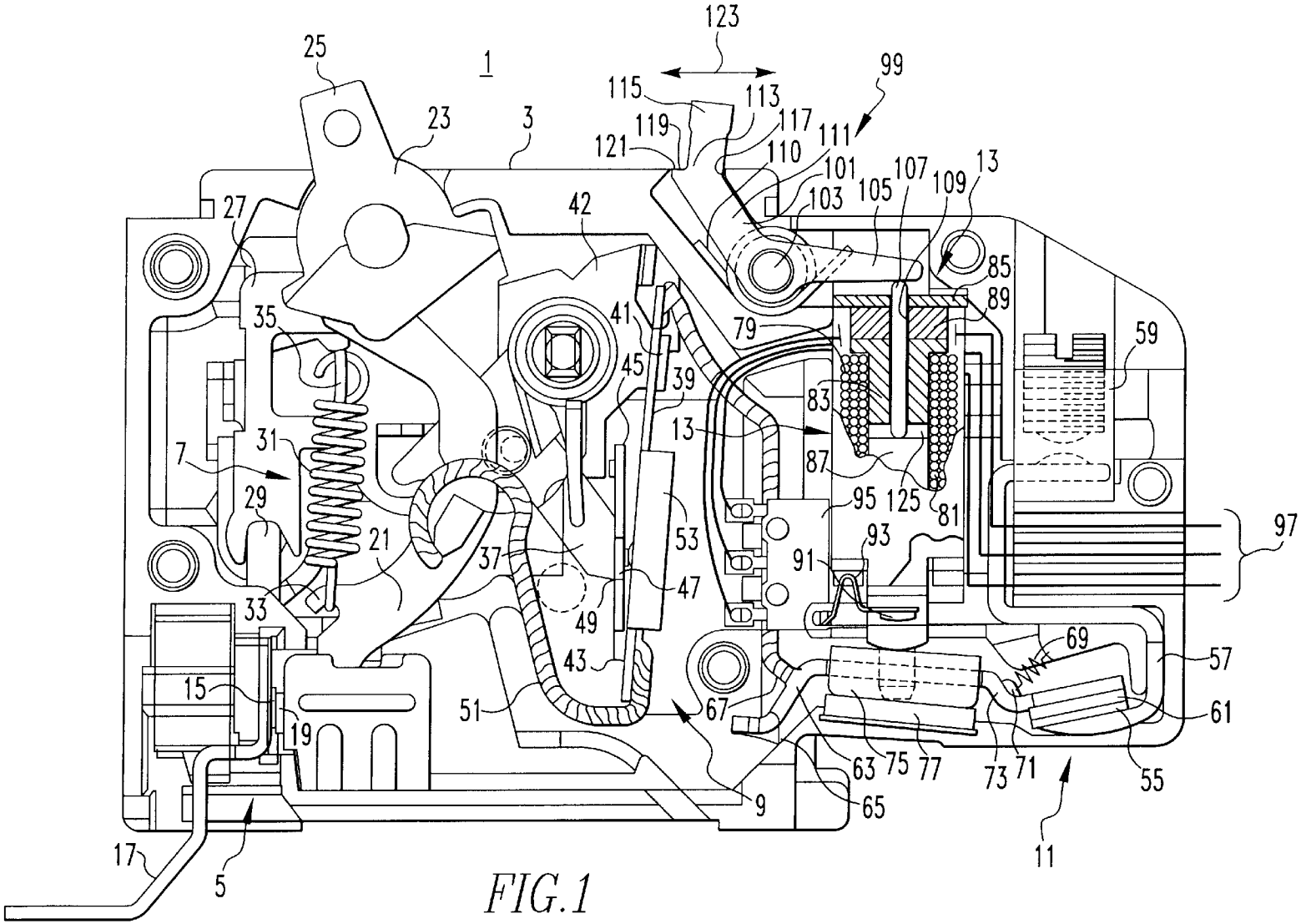
FIG. 1 is an elevational view of a remotely controllable circuit breaker in accordance with the invention shown with the cover removed and with the main contacts and secondary contacts closed.
Figure 2:
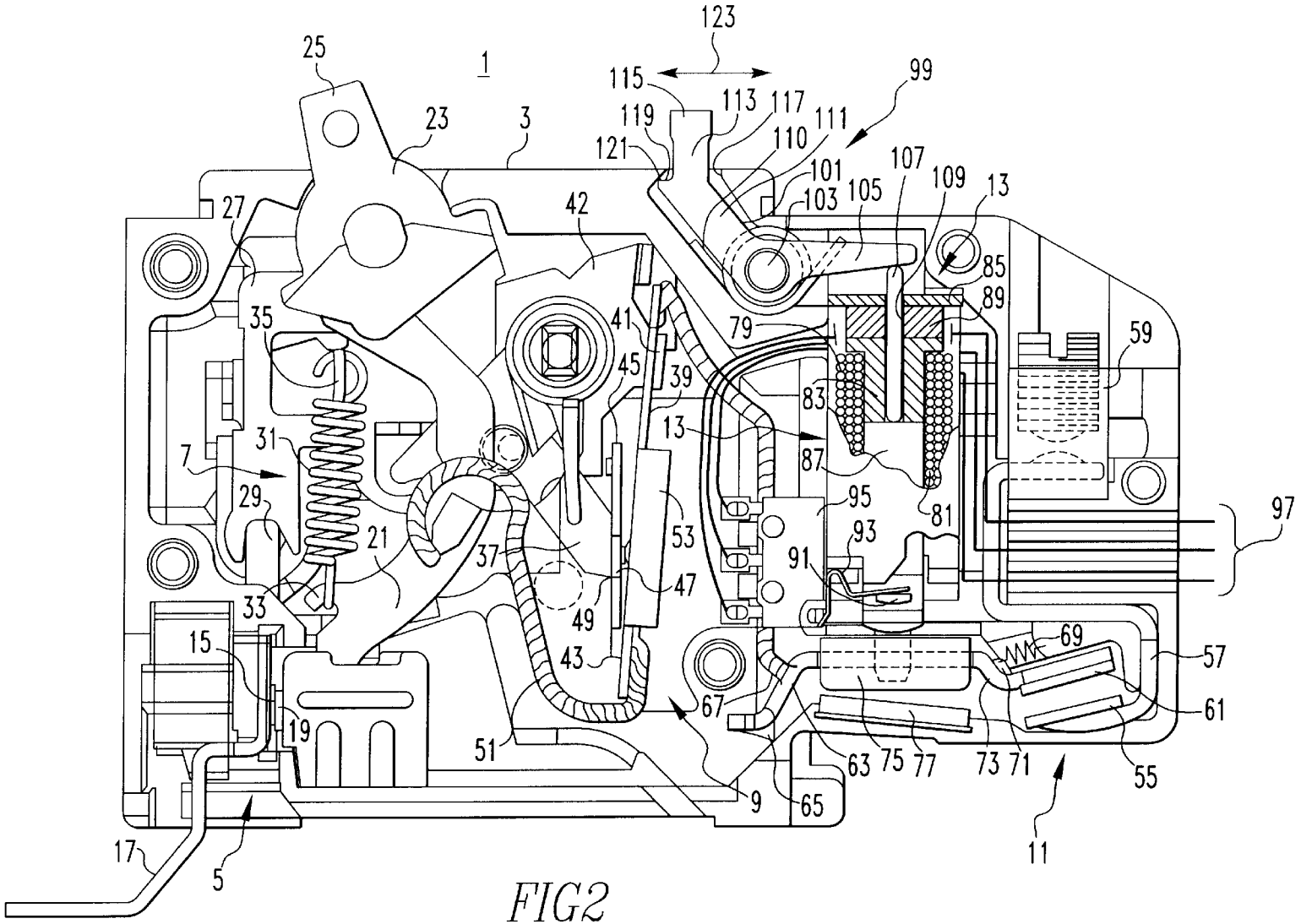
FIG. 2 is a view similar to that of FIG. 1 with the secondary contacts open.

The invention will be described as applied to a miniature circuit breaker, although it will become apparent that it could be applied to other types of circuit breakers as well. Such a miniature circuit breaker 1 includes a molded housing 3 and is shown in FIGS. 1 and 2 with the cover of the housing removed. The basic components of the circuit breaker 1 are a set of main contacts 5, an operating mechanism 7 for opening the set of main contacts 5, and a thermal-magnetic trip device 9 which actuates the operating mechanism to trip the set of main contacts 5 open in response to certain overcurrent conditions. Further included are a set of secondary contacts 11 and an actuator 13 in the form of a magnetically latchable solenoid 13 which is remotely controllable to control the open and closed states of the set of secondary contacts 11. Finally, the circuit breaker 1 includes a manual operator, to be described, for manually closing the set of secondary contacts 11 and which also serves as a position indicator to provide a visual indication external to the molded housing 3 of the open/closed state of the set of secondary contacts 11.

The set of main contacts 5 includes a fixed contact 15 secured to a lined terminal 17 and a moveable main contact 19 which is affixed to an arcuate contact arm 21 which forms part of the operating mechanism 7. The operating mechanism 7 is a well-known device which includes a pivotally mounted operator 23 with an integrally molded handle 25. The operating mechanism 7 also includes a cradle 27 pivotally mounted on a support 29 molded in the housing 3. With the handle 25 in the closed position, as shown in FIGS. 1 and 2, a spring 31 connected to a hook 33 on the contact arm 21 and a tab 35 on the cradle 27 holds the main contacts 5 closed. The spring 31 also applies a force with the set of main contacts 5 closed, as shown, to the cradle 27 which tends to rotate the cradle in a clockwise direction about the support 29. However, the cradle has a finger 37 which is engaged by the thermal-magnetic trip device 9 to prevent this clockwise rotation of the cradle under normal operating conditions.

The thermal-magnetic trip device 9 includes an elongated bimetal 39 20 which is fixed at its upper end to a tab 41 on the metal frame 42 seated in the molded housing 3. Attached to the lower, free end of the bimetal 39 by a leaf spring 43 is an armature 45. The armature 45 has an opening 47 which is engaged by a latching surface 49 on the finger 37.

The free end of the bimetal 39 is connected to the contact arm 21 by a flexible braided conductor 51 so that the load current of the circuit protected by the circuit breaker 1 passes through the bimetal. A persistent overcurrent heats the bimetal, which causes the lower end to move to the right, as shown in FIGS. 1 and 2. If this overcurrent is of sufficient magnitude and duration, the latching surface 49 on the finger 37 is pulled out of engagement with the armature 45. This allows the cradle 27 to be rotated clockwise by the spring 31. The clockwise rotation of the cradle 27 moves the upper pivot point for the contact arm across the line of force of the spring 31 so that the contact arm is rotated counterclockwise to open the set of main contacts (not shown), as is well understood. This also results in the handle 25 rotating to an intermediate position to indicate the tripped condition of the set of main contacts 5.

In addition to the armature 45, a magnetic pole piece 53 is supported by the bimetal 39. Very high overcurrents, such as those associated with a short circuit, produce a magnetic field which draws the armature 45 to the pole piece 53, thereby also releasing the cradle 27 and tripping the set of main contacts 5 open. Following either trip, the main set of contacts 5 are reclosed by moving the handle 25 fully clockwise, which rotates the cradle 27 counterclockwise until the finger 37 relatches in the opening 47 in the armature 45. Upon release of the handle, it moves counterclockwise slightly from the full clockwise position and remains there. With the cradle relatched, the line of force of the spring 31 is reestablished to rotate the contact arm 21 clockwise to close the set of main contacts 5 when the handle 25 is rotated fully counterclockwise to the on position shown in FIGS. 1 and 2.

The set of secondary contacts 11 includes a fixed secondary contact 55 which is secured on a load conductor 57 which leads to a load terminal 59. The set of secondary contacts 11 also includes a moveable secondary contact 61 which is fixed to a secondary contact arm 63 which at its opposite end is seated in a molded pocket 65 in the molded housing 3. The secondary contact arm 63 is electrically connected in series with the set of main contacts 5 by a second flexible braided conductor 67 connected to the fixed end of the bimetal 39. Thus, a circuit for load current is established from the line terminal 17 through the set of main contacts 5, the contact arm 21, the flexible braided conductor 51, the bimetal 39, the second flexible braided conductor 67, the secondary contact arm 63, the set of secondary contacts 11, the load conductor 57 to the load terminal 59.

The set of secondary contacts 11 is biased to the closed state shown in FIG. 1 by a helical compression spring 69 seated on a projection 71 on an offset 73 in the secondary contact arm 63. As discussed in U.S. Patent No. 5,301,083, the spring 69 is oriented such that the force that it applies to the secondary contact arm 63 tending to close the set of secondary contacts is relaxed to a degree with the set of secondary contacts in the open position. This serves the dual purpose of providing the force needed to close the set of secondary contacts against rated current in the protected circuit and also reducing the force that must be generated by the magnetically latching solenoid 13 to hold the set of secondary contacts in the open state. In order for the set of secondary contacts 55 to withstand short circuit currents and allow the set of main contacts 5 to perform the interruption, the magnet force generated by the short circuit current causes an armature 75 mounted on the secondary contact arm 63 to be attracted to a pole piece 77 seated in the molded housing thereby clamping the secondary contacts closed.

As shown by the partial sections in FIGS. 1 and 2, the actuator/solenoid 13 includes a first or close coil 79 and a second or open coil 81 concentrically wound on a steel core 83 supported by a steel frame 85. A plunger 87 moves rectilinearly within the coils 79 and 81. A permanent magnet 89 is seated between the steel core 83 and the steel frame 85.

The plunger 87 engages the secondary contact arm 63. When the close coil 79 is energized, a magnetic field is produced which drives the plunger downward to a first position which rotates the secondary contact arm 63 clockwise and thereby moves the set of secondary contacts 11 to the closed state. The secondary contacts 11 are maintained in the closed state by the spring 69. When it is desired to open the set of secondary contacts 11, the open coil 81 is energized which lifts the plunger and with it the secondary contact arm 63 to open the secondary set of contacts. With the plunger in the full upward position as shown in FIG. 2, it contacts the steel core 83 and is retained in this second position by the permanent magnet 89. Subsequently, when the close coil 79 is energized, the magnetic field generated is stronger than the field of the permanent magnet and therefore overrides the latter and moves the plunger 87 back to the first, or closed position. A projection 91 on the plunger 87 engages an actuating lever 93 on a microswitch 95 which, as discussed in co-pending Application 99-PDC-269, controls remote operation of the solenoid 13 by signals provided over a remotely operable control circuit represented by control leads 97. As the second set of contacts 11 are held closed by the spring 69 and held open by the magnetic latching provided by the permanent magnet 89, only momentary signals are needed to operate the set of secondary contacts to the open and closed states.

Figure 3:
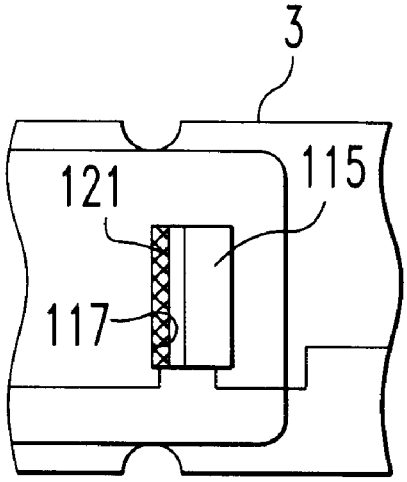
FIG. 3 is a fragmentary top view of a portion of the circuit breaker of FIG. 1.
Figure 4:
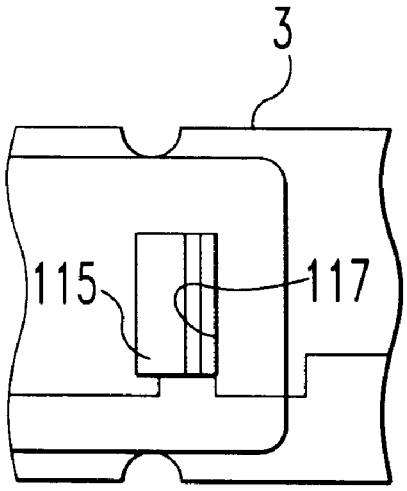
FIG. 4 is a fragmentary top view of a portion of the circuit breaker of FIG. 2.

In order to provide a visible indication at the circuit breaker of the pen/closed state of the set of secondary contacts 11 and to provide the capability of verriding the solenoid 13 and manually closing the set of secondary contacts, an operator/indicator 99 is provided. This operator/indicator 99 includes an operating member/indicator member 101 pivotally supported on a mount formed by a pin 103 molded in the housing 3. The operating member/indicator member 101 has a first leg 105 which is coupled to the plunger 87 of the solenoid 13 by a coupling in the form of a non-magnetic pin 107 which extends through a central aperture 109 through the steel frame 85, permanent magnet 89 and core 83 of the plunger. A torsion spring 110 bears against the first leg 105 to bias the operating member/indicator member 101 against the plunger 87 through the coupling pin 107. The operating member/indicator member 101 has a second leg 111 which has a base portion 113 and an extension 115 which projects outward through an opening 117 in the housing 3. The projection 115 is offset on the base 113 to provide a ledge 119 on which indicia 121 is placed, providing an indication of the closed state of the set of secondary contacts 11. This indicia 121 can be a strip of color or any other suitable indicator of the state of the secondary contacts. As will be noticed from FIG. 2, the opening 117 is undercut so that with the set of secondary contacts 11 in the open state and, thus, with the plunger 87 magnetically latched upward against the steel core 83, the operating member/indicator member 101 is rotated counterclockwise against the bias of the spring 109 so that the indicia 121 is not visible external to the housing 3. However, as shown in FIGS. 1 and 3, when the plunger is operated to the first, or down, position to close the secondary contacts 11, the torsion spring 110 causes the operating member/indicator member 101 to follow the plunger 87 and thereby rotate clockwise, as viewed in FIG. 1, so that the indicia 121 is visible, as shown in FIG. 3.

With the set of secondary contacts open, as shown in FIG. 2, the extension 115 can be pushed to the right as shown by the arrow 123, to rotate the operating member/indicator member 101 clockwise, thereby depressing the coupling pin 107 and driving the plunger 87 downward to open a gap 125 between the core 83 and the plunger 87, so that the set of secondary contacts 11 is closed and held closed by the spring 69.

Thus, the operating member/indicator member 101 performs the dual function of providing a visible indication external to the housing 3 of the open/closed state of the set of secondary contacts 11, and also provides a means for manually losing the set of secondary contacts.

In an alternative arrangement, the coupling pin 107 can be mechanically connected to the plunger 87 and the operating member/indicator member 101. For instance, the lower end of the coupling pin 107 can be pressed into the plunger and the upper end can be connected to the first leg 105 of the operating member/indicator member 101 by a ball and socket joint.

While a specific embodiment of the invention has been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A remotely controllable circuit breaker comprising:

a housing;

a set of main contacts mounted in said housing;

an operating mechanism mounted in said housing coupled to said set of main contacts for opening and closing said main contacts;

a set of secondary contacts mounted in said housing and connected in series with said set of main contacts, said set of secondary contacts having an open state and a closed state;

a remotely operated actuator mounted in said housing selectively moving said set of secondary contacts between said open and closed states;

a position indicator supported by said housing and providing an indication observable external to said housing of the open and closed states of said set of secondary contacts;

wherein said actuator comprises a solenoid having a plunger movable to a first position in which said set of secondary contacts is in said closed state and a second position in which said set of secondary contacts is in said open state, and a coupling coupling said position indicator to said plunger for movement therewith to a first indicator position when said plunger is in said first position to provide an indication of said closed state of said set of secondary contacts and to a second indicator position when said plunger is in said second position to provide an indication of said open state of said set of secondary contacts; and wherein said position indicator comprises an indicator member and a spring biasing said indicator member to follow said plunger.

2. A remotely controllable circuit breaker comprising:

a housing;

a set of main contacts mounted in said housing;

an operating mechanism mounted in said housing coupled to said set of main contacts for opening and closing said main contacts;

a set of secondary contacts mounted in said housing and connected in series with said set of main contacts, said set of secondary contacts having an open state and a closed state;

a remotely operated actuator mounted in said housing selectively moving said set of secondary contacts between said open and closed states;

a position indicator supported by said housing and providing an indication observable external to said housing of the open and closed states of said set of secondary contacts;

wherein said actuator comprises a solenoid having a plunger movable to a first position in which said set of secondary contacts is in said closed state and a second position in which said set of secondary contacts is in said open state, and a coupling coupling said position indicator to said plunger for movement therewith to a first indicator position when said plunger is in said first position to provide an indication of said closed state of said set of secondary contacts and to a second indicator position when said plunger is in said second position to provide an indication of said open state of said set of secondary contacts;

wherein said position indicator is manually movable from said second indicator position to said first indicator position to manually move said plunger to said first position and therefore manually operating said set of secondary contacts to said closed state; and wherein said actuator includes means latching the plunger in said second position, and said position indicator unlatches said plunger from said second position when said indicator is manually moved from said second indicator position.

3. A remotely controllable circuit breaker comprising:

a housing;

a set of main contacts mounted in said housing;

an operating mechanism mounted in said housing coupled to said set of main contacts for opening and closing said main contacts;

a set of secondary contacts mounted in said housing and connected in series with said set of main contacts, said set of secondary contacts having an open state and a closed state;

a remotely operated actuator mounted in said housing selectively moving said set of secondary contacts between said open and closed states;

a position indicator supported by said housing and providing an indication observable external to said housing of the open and closed states of said set of secondary contacts;

wherein said actuator comprises a solenoid having a plunger movable to a first position in which said set of secondary contacts is in said closed state and a second position in which said set of secondary contacts is in said open state, and a coupling coupling said position indicator to said plunger for movement therewith to a first indicator position when said plunger is in said first position to provide an indication of said closed state of said set of secondary contacts and to a second indicator position when said plunger is in said second position to provide an indication of said open state of said set of secondary contacts; and wherein said plunger moves rectilinearly, said position indicator comprises an indicator member and said coupling comprises a non-magnetic pin coupling said plunger and said indicator member.

4. A remotely controllable circuit breaker comprising:

a housing;

a set of main contacts mounted in said housing;

an operating mechanism mounted in said housing and coupled to said set of main contacts for opening and closing said main contacts;

a set of secondary contacts mounted in said housing and connected in series with said set of main contacts and having an open state and a closed state;

a solenoid having a plunger moveable to a first position to operate said set of secondary contacts to said closed state and moveable to a second position to operate and set of secondary contacts to said open state;

a remotely operable control circuit magnetically operating said plunger to said first and second positions;

a manual operator coupled to said plunger in said housing and manually operable from outside said housing to manually move said plunger from said second position to manually operate said set of secondary contacts to said closed stated;

wherein said housing has an opening and said manual operator has an operating member projecting outward through the opening and coupled to said plunger;

wherein said manual operator further includes a mount pivotally mounting said operating member to rotate to move said plunger from said position to said first position to operate said set of secondary contacts to said closed state;

wherein said operating member has a first leg coupled to said plunger and a second leg projecting through said opening in said housing, said second leg being rotated in said opening to move said plunger from said first position to said second position; and wherein said second leg of said operating member has an indicia indicative of one of said opening and closed states of said set of secondary contacts visible through said opening in said housing when said set of secondary contacts is in one of said open and closed states, said indicia being rotated out of view through said opening in said housing when said set of secondary contacts is in the other of said open and closed states.

5. The remotely controllable circuit breaker of claim 1 wherein said plunger moves rectilinearly and said coupling comprises a non-magnetic pin interposed between said plunger and said indicator member, said spring biasing said indicator member against said pin, which in turn is biased against said plunger.

6. The remotely controllable circuit breaker of claim 5 wherein said position indicator further includes a mount pivotally mounting said indicator member for rotation to follow said pin, said housing having an opening through which said rotation of said indicator member is visible to provide said indication of the state of said set of secondary contacts.

7. The remotely controllable circuit breaker of claim 1 wherein said indicator further includes a mount pivotally mounting said indicator member for rotation between said first and second indicator positions, said housing having an opening through which said rotation of said indicator member is visible to provide said indication of the state of said set of secondary contacts.

8. The remotely controllable circuit breaker of claim 7 wherein said position indicator member has a first leg biased by said spring to follow said plunger, and a second leg projecting through said opening in said housing and manually moveable to move said plunger from said second position to said first position to manually operate said set of secondary contacts to said closed state.

9. The remotely controllable circuit breaker of claim 8 wherein said second leg has a base section with indicia thereon indicative of one of said open and closed states of said set of secondary contacts, said indicia being rotated out of alignment with said opening when said set of secondary contacts is in the other of said open and closed states.

10. The remotely controllable circuit breaker of claim 9 wherein said one state is said closed state of said set of secondary contacts.

11. The remotely controllable circuit breaker of claim 7 wherein said indicator member has indicia indicative of one of said open and closed states of said set of secondary contacts visible though said opening in said housing when said set of secondary contacts is in said one state, said indicia being rotated out of view through said opening in said housing when said set of secondary contacts is in the other of said open and closed states.

12. The remotely controllable circuit breaker of claim 11 wherein said one state is said closed state of said set of secondary contacts.

13. The remotely controllable circuit breaker of claim 1 wherein said housing has an indicator opening and said indicator member has indicia indicative of one of said open and closed states visible when said set of secondary contacts is in the one state, said indicia not being visible when said set of secondary contacts is in the other of said open and closed states.

14. The remotely controllable circuit breaker of claim 3 wherein said position indicator further includes a mount pivotally mounting said indicator member for rotation between said first and second indicator positions, said housing having an opening through which said rotation of said indicator member is visible to provide said indication of the state of said set of secondary contacts.

15. The remotely controllable circuit breaker of claim 14 wherein said indicator member has a first leg coupled to follow said plunger, and a second leg projecting through said opening in said housing and manually moveable to move said plunger from the second position to said first position to manually operate said set of secondary contacts to said closed state.

16. The remotely controllable circuit breaker of claim 15 wherein said second leg has a base section within indicia thereon indicative of one of said open and closed states of said set of secondary contacts, said indicia being rotated out of alignment with said opening when said set of secondary contacts is in the other of said open and closed states.

17. The remotely controllable circuit breaker of claim 16 wherein said indicator member has indicia indicative of one of said open and closed states of said set of secondary contacts visible through said opening in said housing when said set of secondary contacts is in said one state, said indicia being rotated out of view through said opening in said housing when said set of secondary contacts is in the other of said open and closed states.

* * * * *